US010376132B2

(12) United States Patent
Slone

(10) Patent No.: US 10,376,132 B2
(45) Date of Patent: Aug. 13, 2019

(54) NON-CYLINDRICAL ADHESIVE ROLLER ASSEMBLY

(71) Applicant: Joshua Ralph Slone, Mission Viejo, CA (US)

(72) Inventor: Joshua Ralph Slone, Mission Viejo, CA (US)

( * ) Notice: Subject to any disclaimer, the term of this patent is extended or adjusted under 35 U.S.C. 154(b) by 315 days.

(21) Appl. No.: 15/584,884

(22) Filed: May 2, 2017

(65) Prior Publication Data

US 2017/0319046 A1 Nov. 9, 2017

Related U.S. Application Data

(63) Continuation-in-part of application No. 62/332,360, filed on May 5, 2016.

(51) Int. Cl.

| | |
|---|---|
| ***A47L 25/00*** | (2006.01) |
| ***B08B 7/00*** | (2006.01) |
| ***B65H 16/00*** | (2006.01) |

(52) U.S. Cl.

CPC ..... *A47L 25/005* (2013.01); *B08B 7/0028* (2013.01); *B65H 16/005* (2013.01); *B65H 2402/412* (2013.01)

(58) Field of Classification Search

CPC ..... A47L 25/005; A47L 25/00; B08B 7/0028; B65H 16/005; C09J 7/04

See application file for complete search history.

(56) References Cited

U.S. PATENT DOCUMENTS

| | | | | |
|---|---|---|---|---|
| 2,624,060 | A | 1/1953 | Mckenzie | |
| 3,343,194 | A | 9/1967 | Ramelson | |
| D342,610 | S | 12/1993 | Stetson et al. | |
| D463,134 | S | 9/2002 | Vosbikian | |
| 7,896,824 | B2 * | 3/2011 | Gueret | A61H 15/00 601/120 |
| D637,403 | S | 5/2011 | Schmidt | |
| D690,944 | S | 10/2013 | Lee et al. | |
| 8,844,543 | B2 | 9/2014 | Bickford et al. | |
| 2003/0135941 | A1 | 7/2003 | Vosbikian | |
| 2005/0204493 | A1 | 9/2005 | Legus et al. | |
| 2007/0163062 | A1 | 7/2007 | McKay | |

* cited by examiner

*Primary Examiner* — Shay Karls
(74) *Attorney, Agent, or Firm* — David Duckworth

(57) ABSTRACT

An adhesive roller assembly is provided having a non-cylindrical roller. The non-cylindrical roller is rotatably affixed to a handle's distal end. In addition, adhesive tape is helically wrapped about the roller, and the adhesive tape includes perforations so as to facilitate the breaking of the adhesive tape into individual segments. Because the roller has a non-cylindrical circumferential surface, the adhesive tape is deformed to have a non-cylindrical exterior. The roller, and consequentially exterior of the adhesive tape, can take various forms. In preferred embodiments, the roller and tape exterior have a concave, convex, undulating, dimpled or bumpy surface. The adhesive tape is made of material providing increased elongation.

12 Claims, 9 Drawing Sheets

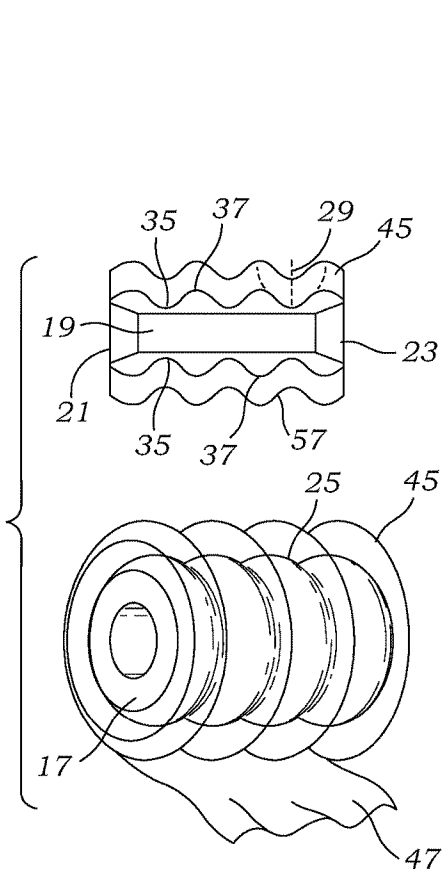
Fig. 13
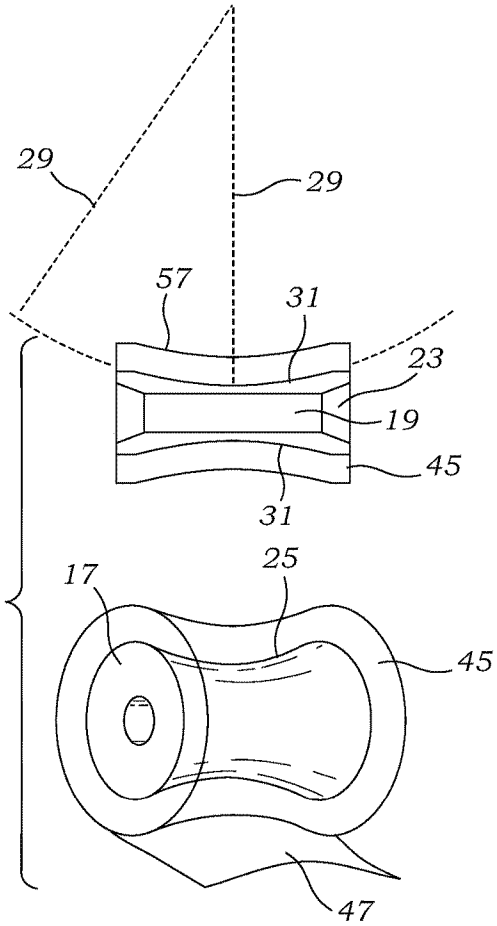
Fig. 14
Fig. 15

NON-CYLINDRICAL ADHESIVE ROLLER ASSEMBLY

RELATED APPLICATIONS

This application is a continuation-in-part of U.S. Provisional Patent Application No. 62/332,360 filed on May 5, 2016.

BACKGROUND OF THE INVENTION

The present invention relates to cleaning such as for collecting lint, threads, hair, dust, dirt and other loose foreign matter.

Adhesive assemblies, also commonly referred to as lint rollers, have been around since the early 1900's, and have proven to be very effective and popular in removing dirt and other particulates. A traditional adhesive roller assembly includes a cylindrically shaped drum, also referred to as the roller, which is rotatably affixed to a handle. Paperbacked adhesive tape has been wound around the cylindrical roller. Typically, the tape is affixed at its inner end to the roller and then wrapped around about the roller with an adhesive tacky surface facing outwardly. Typically, the adhesive tape is perforated so as to facilitate removal of segments of tape referred to as adhesive sheets.

In practice, the adhesive roller assembly is grasped by the handle and a person causes the roller to roll over material that is to be cleaned. As the roller rolls over material to be cleaned, any loose particulates are adhered to the tape's outer tacky layer. When the outer tacky layer is thoroughly coated with particulates, then this layer is removed by lifting the end of the tape and pulling the tape segment away from the inner layers of adhesive tape until the tape segment can be removed by tearing the tape perforations leaving a fresh outer layer adhesive material.

Various attempts have been made to improve adhesive roller assemblies through the years. For example, U.S. Pat. No. 3,343,194 describes an adhesive roller assembly with an improved handle and adhesive tape which facilitates the removal of tape segments. U.S. Patent Application Serial No. 2003/0135941 describes an adhesive roller assembly purporting to have an improved handle construction. Meanwhile, U.S. Patent Application Serial No. 2005/0204493 describes an adhesive roller assembly for use in removing loose hairs from a person's beard. The roller assembly's tape is scented with a pleasant fragrance to improve a person's experience.

Unfortunately, the prior adhesive roller assemblies suffer from a significant disadvantage. Because roller assemblies employ a cylindrical roller having a surface that is straight longitudinally, the rollers surface is effective for use in removing unwanted particulates off flat or linear surfaces, meaning that the flat axially aligned surface of the cylindrical roller rolls evenly over a flat or linear surface. Unfortunately, these prior adhesive roller assemblies are not effective in removing unwanted particulates from curved surfaces. For example, traditional adhesive roller assemblies are utilized on numerous convex surfaces including the armrest and backings of sofas and chairs, pillows and even the facial features of a person's face to remove unwanted hair. Adhesives rollers are also utilized on concave surfaces such as within the valleys and depressions of upholstery. Unfortunately, the cylindrical rollers of adhesive roller assemblies only make minimal contact upon these convex and concave surfaces resulting in little surface area of the adhesive picking up unwanted particulates.

Accordingly, there is a significant need for an adhesive roller assembly that is optimal for use on non-linear surfaces such as convex or concave surfaces.

In addition, there is a significant need for an adhesive roller assembly for removing unwanted particulates from soft and malleable surfaces such as upholstery or the human skin.

SUMMARY OF THE INVENTION

The present invention addresses the aforementioned disadvantages by providing an improved adhesive roller assembly for use on various curved surfaces.

The adhesive roller assembly includes three primary components, namely a handle, a roller, and adhesive tape. The handle can take various forms, and preferably includes a proximal end and a distal end. The roller is rotatably affixed to the handle's distal end. The roller may be affixed to the handle by various constructions that permit rotational attachment as can be determined by those skilled in the art. In a preferred embodiment, a hollow shaft extends from the handle's distal end which is sized to project into a center bore formed in the roller.

Meanwhile, the roller is substantially barrel or drum shaped with the roller's central center bore coincident with the roller's central axis. Though the roller's cross sections are substantially circular, the roller's circumferential surface is not cylindrical as found in traditional adhesive roller assemblies. Instead, the roller's circumferential surface has one or more concentric concave or convex regions.

In a first preferred embodiment, the roller has a circumferential surface that is concave and extends from the roller's first end to the roller's second end. In an alternative preferred embodiment of the invention, the roller's circumferential surface has a concentric convex shape which extends from the roller's first end to the roller's second end. Preferably, the roller's concave or convex region has a maximum radius of 7.5 inches and a minimum radius of curvature of 1.25 inches wherein the "radius of curvature" is defined in the traditional manner which equals the radius of the circular arch which best approximates the curve at that point. The radius of curvatures is also defined to mean the radius of a circle that best fits a normal section of the roller's circumferential surface.

In still an additional preferred embodiment, the roller's circumferential surface has one or more concentric concave regions and one or more concentric convex regions so as to provide an undulating surface. Again, it is preferred that each concave section and convex section has a radius of curvature between 7.5 inches and 1.25 inches.

In still additional embodiments, the roller's circumferential surface includes convex protuberances and/or concave depressions. The roller's circumferential surface may have a concentrically concave or convex shape as described above. However, the roller may have a generally cylindrical shape thus having a substantially uniform diameter throughout the roller's length except for where the circumferential surface includes convex dimples or concave depressions so as to make the roller's circumferential surface non-cylindrical. It is preferred that the convex protuberances and concave depressions have a radius of curvature between 7.5 inches and 1.25 inches.

The roller may be constructed in various shapes, sizes and of various materials as can be determined by those skilled in the art. For example, the roller's width can be any dimensions. However, preferred roller constructions have a width of 1.25-6 inches from the roller's first end to the roller's second end, and have a concave or convex circumferential surface having a radius of curvature between 7.5 inches and 1.25 inches. An even more preferred embodiment of the adhesive roller assembly incorporates a roller having a width of 2.5 inches and a radius of curvature of 4-5 inches.

The adhesive roller assembly further includes adhesive tape which is helically wrapped around the rollers non-cylindrical circumferential surface. The adhesive tape includes an adhesive on the tape's exterior surface so as to provide a tacky coating for adhering to and picking up loose particles. Preferably, the adhesive tape includes longitudinally extending perforations facilitating the breaking of the adhesive tape into individual segments.

Because the roller has a non-cylindrical circumferential surface, the wrapping of the adhesive tape around the roller in an annular configuration results in the adhesive tape, and in turn the individual adhesive sheets, having a non-cylindrical exterior which substantially mirrors the shape of the underlying roller. Of importance, the adhesive sheets are manufactured of a material which provides at least 12% elongation. As defined herein, "elongation" has its traditional meaning and is defined as the length at breaking point expressed as a percentage of its original length. In other words, the adhesive tape for use with the adhesive roller assembly will not break when pulled until it has reached at least 12% of its original length. For rollers having a circumferential surface with concave or convex regions having smaller radius of curvatures, it is preferred that the adhesive tape be made of a material of greater elongation. For example, for a roller having a 2.5 inch width, and a convex or concave region with a 6 inch radius of curvature, it is preferred that the tape material have an elongation of at least 20%. Meanwhile, for a roller having a 2.5 inch width and a concave or convex region having a radius of curvature of 5 inches, it is preferred that the tape material have an elongation of 150% or more. Similarly, a preferred roller assembly having a roller with a 2.5 inch width and a concave or convex surface with a 4 inch radius of curvature is made of a material providing 200% elongation or greater.

A preferred material for the tape having adequate elongation includes polyethylene which has an elongation of 200%-400%. Another preferred material for the adhesive tape includes polyurethane having an elongation of 300% or more. The exterior coating of adhesive formed on the adhesive tape can be selected by those skilled in the art. Preferred materials include artificial rubber, silicone and acrylic. A preferred adhesive is a 0.3 mil layer of rubber/acrylic. In addition, the adhesive tape may be coated on its interior side with a release agent composed of silicone, Teflon or other material so as to impede one layer of adhesive tape from adhering to another.

Advantageously, the adhesive roller assembly is ideal for collecting unwanted particulates from curved surfaces.

Also advantageously, the adhesive roller assembly is inexpensive to manufacture and can be utilized for a wide variety of purposes such as removing lint from upholstery or hair from a recently trimmed beard.

Other features and advantages of the present invention will be appreciated by those skilled in the art upon reading the detailed description which follows with reference to the drawings.

BRIEF DESCRIPTION OF THE DRAWINGS

FIG. 13 are side cutaway and perspective views illustrating a roller having a convex circumferential surface;

FIG. 14 are side cutaway and perspective views illustrating a roller having a concave circumferential surface;

FIG. 15 are side cutaway and perspective views illustrating a roller having a convex and concave circumferential surface;

DETAILED DESCRIPTION OF PREFERRED EMBODIMENTS

Figure 1:
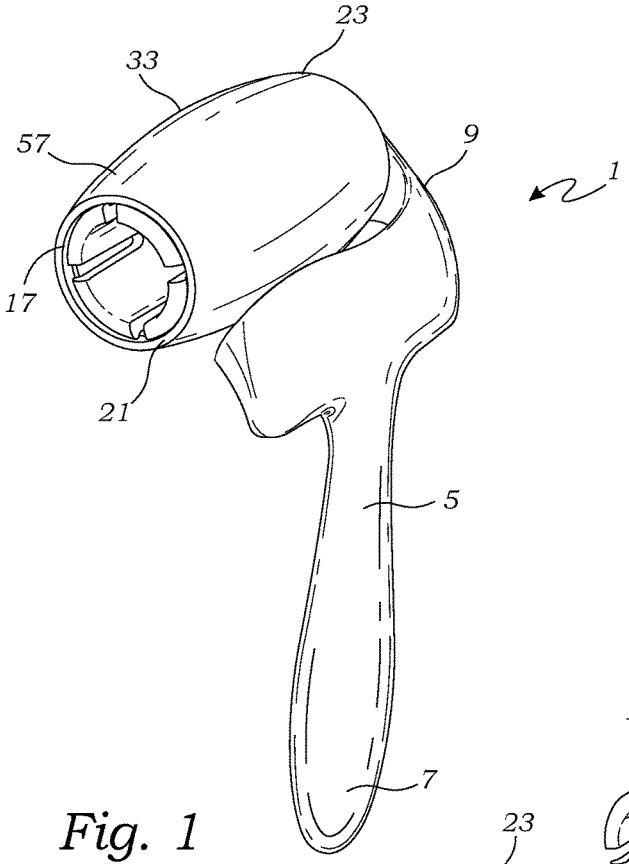
FIG. 1 is a perspective view of an adhesive roller assembly.
Figure 2:
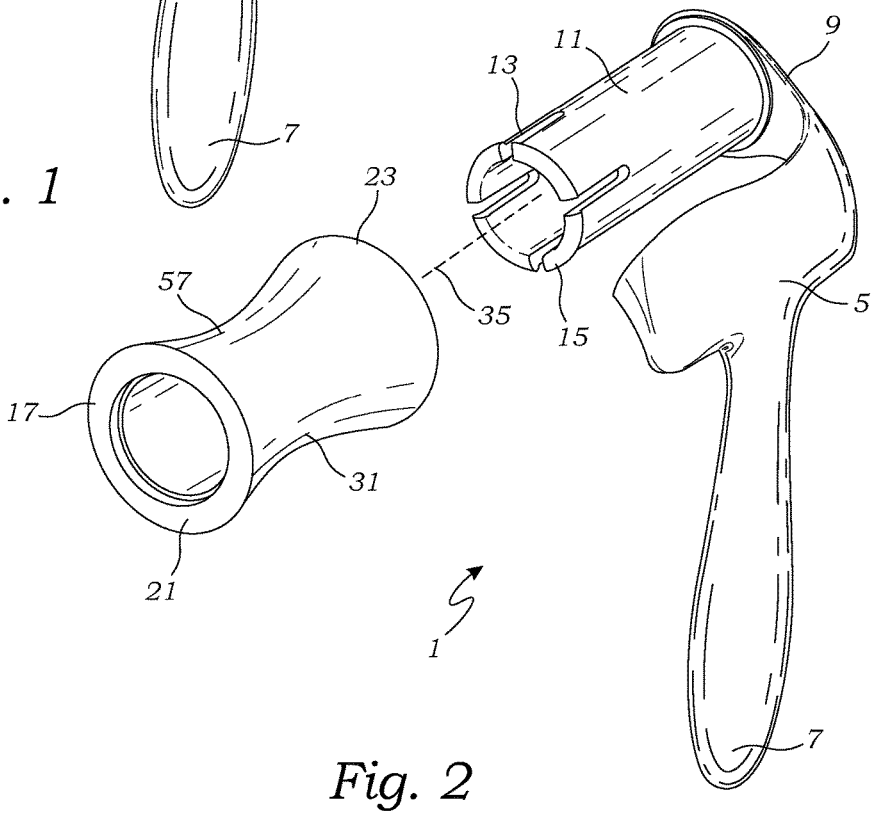
FIG. 2 is an exploded perspective view of an adhesive roller assembly.

While the present invention is susceptible of embodiment in various forms, as shown in the drawings, hereinafter will be described the presently preferred embodiments of the invention with the understanding that the present disclosure is to be considered an exemplification of the invention, and the present disclosure is not intended to limit the invention to specific embodiments illustrated.

With reference to FIGS. 1-20, the adhesive roller assembly 1 of the present invention includes a handle 5 and an adhesive tape wrapped roller 17. The handle 5 has a proximal end 7 and a distal end 9, and the roller is rotatably attached to the handle's distal end. The roller 17 is generally barrel shaped so as to have a center bore 19 coincident with the roller's central axis 35. Furthermore, the roller 17 includes a first end 21 and a second end 23 with the distance between the roller's first end and second end defining the roller's width.

Of importance, the roller 17 has a circumferential surface 25 which is not cylindrical. At each point along the roller's width, the roller's circumferential surface 25 concentrically forms a circle about the roller's central axis 35. However, the distance of the circumferential surface from the central axis varies along the width of the roller so that the roller does not have the cylindrical shape of a traditional adhesive lint roller. As explained in greater detail below, the roller's circumferential surface can take various forms and shapes such as having a concentric concave shape 31, a concentric convex shape 33, or variations thereof.

The roller 17 may be affixed to the handle 5 by various constructions known to those skilled in the art. However, in the preferred embodiment illustrated in FIGS. 1-20, the adhesive roller assembly 1 includes a hollow shaft 11 which extends from the handle's distal end 9. Preferably, the hollow shaft 11 has a length slightly larger than the length of the roller's center bore 19 and the handle's hollow shaft 11 has a diameter slightly smaller than the center bore's diameter so that the hollow shaft can concentrically and rotationally accept the roller 17. To prevent the roller 17 from unintentionally disengaging from the handle 5, preferably the shaft 11 includes an edge 15 which radially extends to partially cover the roller's first end 21. For installation of the roller 17 upon the shaft 11, preferably the shaft's distal end includes flexible fingers 13 so as to allow the hollow shaft's edge 15 to deform radially inward during installation of a roller 17.

Adhesive tape 45 is helically wrapped about the roller 17. Preferably, the adhesive tape has incremental perforations 49 so as to allow the adhesive tape 45 to be broken into easily removable segments 47. In addition, the adhesive tape's exterior 57 is coated with an adhesive 51. Though not shown, preferably the adhesive tape's interior is coated with a release agent.

Figure 12:
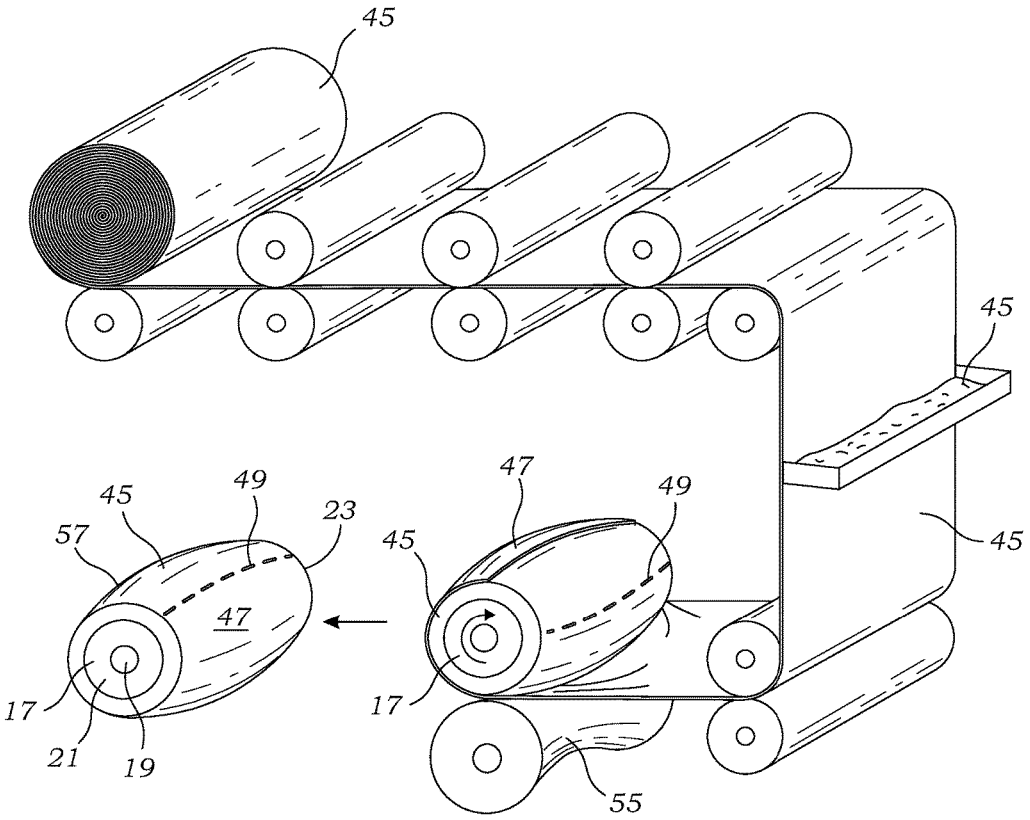
FIG. 12 is a perspective view illustrating the attachment of adhesive tape to a roller having a convex circumferential surface.
Figure 16:
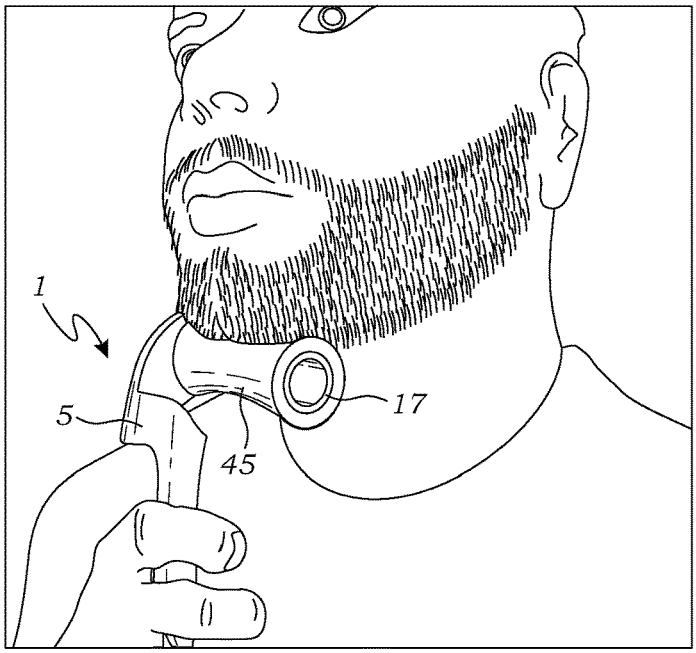
FIG. 16 is a perspective view illustrating a person utilizing the adhesive roller assembly to remove beard hairs.
Figure 17:
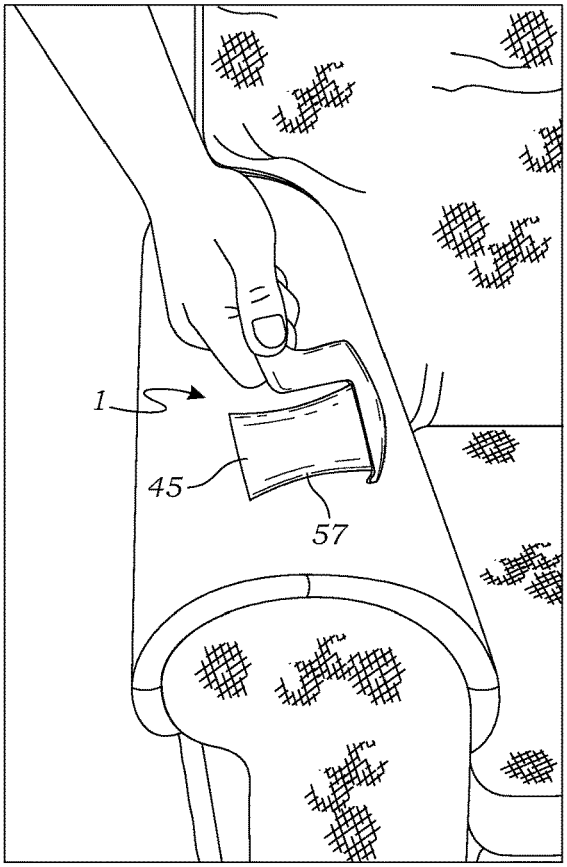
FIG. 17 is a perspective view illustrating a roller assembly having a roller with a concave circumferential surface for use in removing particulates from the arm of a sofa.
Figure 18:
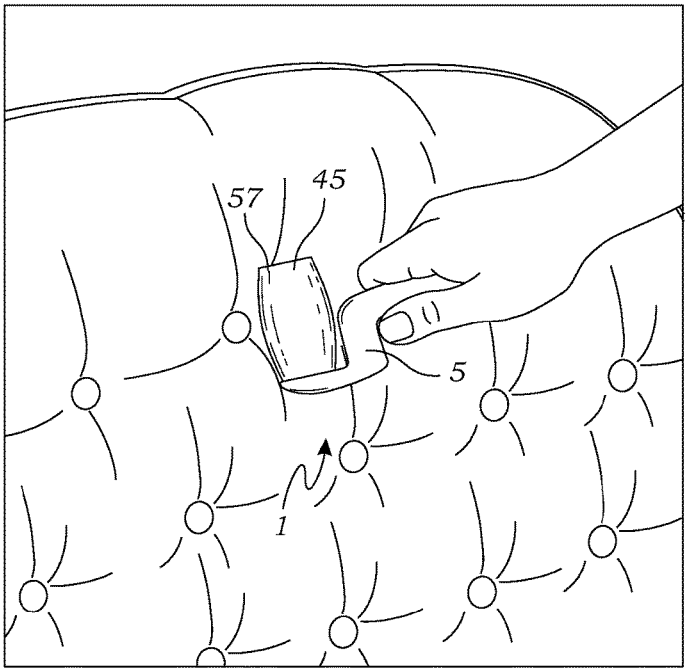
FIG. 18 is a perspective view of an adhesive roller assembly having a convex circumferential surface in use removing particles from the front of a sofa.
Figure 19:
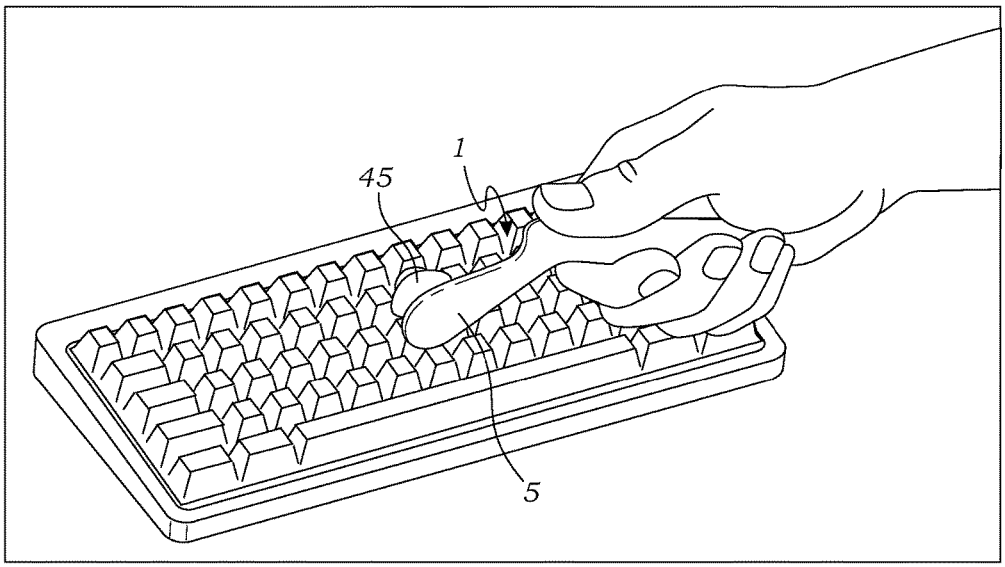
FIG. 19 is a perspective view illustrating an adhesive roller assembly having a small roller with a convex circumferential surface with a particularly small radius of curvature for use in cleaning a computer keyboard.
Figure 20:
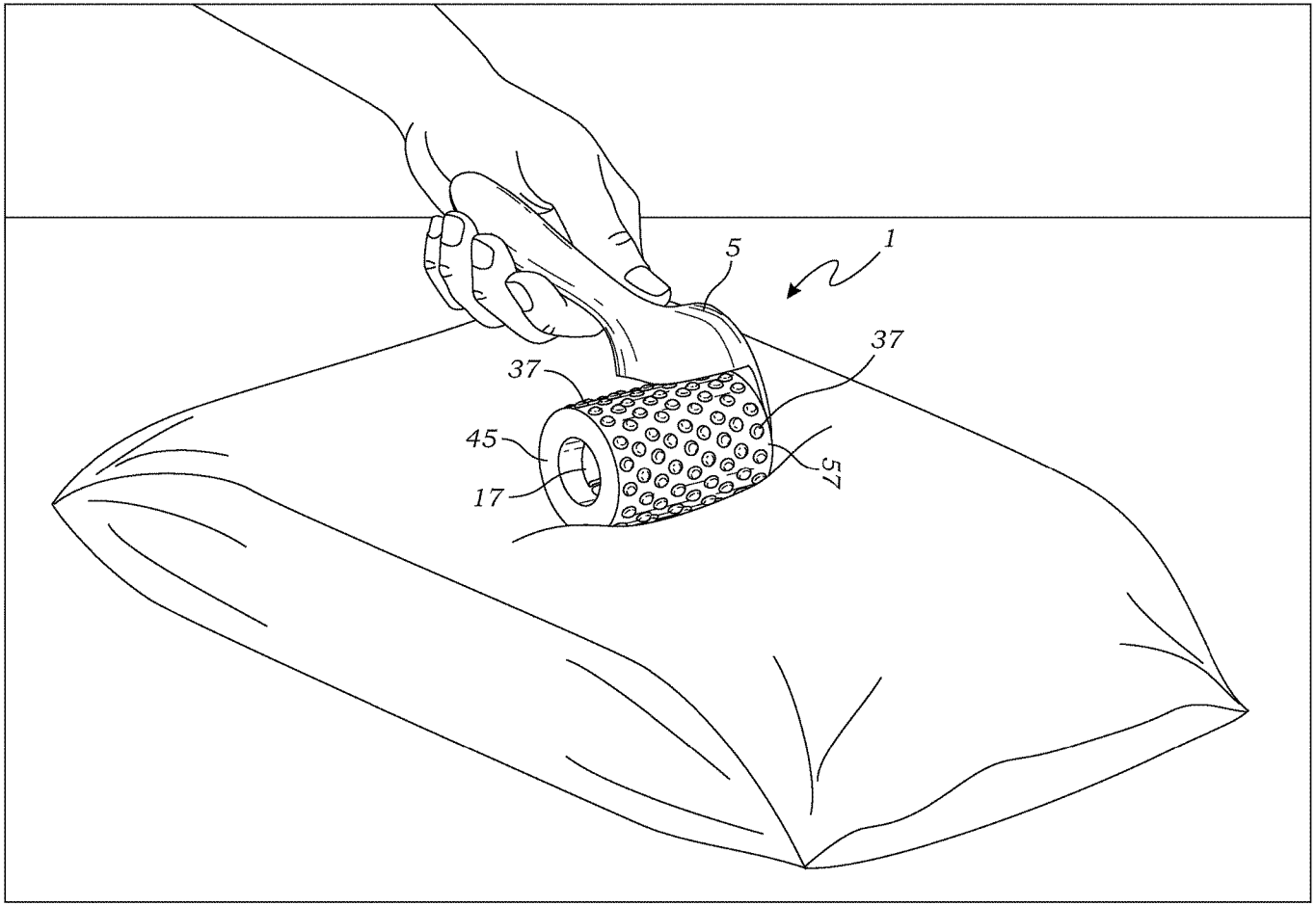
FIG. 20 is a perspective view illustrating an adhesive roller assembly having a roller with convex protuberances for use in cleaning a pillow.

Of importance, the adhesive tape 45 is made of a material providing greater elongation than is typically employed for adhesive tape assemblies. This is important because, as illustrated in FIG. 12, the tape 45 is linear prior to being coated with an adhesive 51 and being wrapped around the roller 17. During the wrapping of the tape 45 around the roller 17, the varied diameter of the roller requires that the tape deform to provide a smooth exterior surface. Traditional lint rollers employ a tape made of paper which does not provide the ductility and corresponding elongation to properly wrap a non-cylindrical roller. Accordingly, the adhesive roller assembly of the present invention employs a ductile tape providing at least 12%. The amount of elongation necessary depends on various factors including the width and curvature of the roller's circumferential surface.

Preferably, the adhesive tape base material has an elongation of at least 12% which is believed acceptable where the roller's circumferential surface 25 has departed only nominally from a cylindrical shape. However, the smaller the radius of curvature found on the roller's circumferential surface 25, results in the need for a greater elongation of the adhesive tape material. For example, a roller having a circumferential surface with a concave or convex region with a radius of curvature of approximately 6 inches requires adhesive tape with an elongation of at least 20%. For a roller 17 having a circumferential surface 25 with a convex or concave region having a radius of curvature of 5 inches preferably employs an adhesive tape material providing elongation of at least 150%. A roller 17 having an even more radical concave or convex region incorporating a 4 inch radius of curvature is preferably wrapped with an adhesive tape material having an elongation of 200% or more.

With the foregoing in mind, a first preferred roller assembly includes a roller 17 having a circumferential surface with a concentric convex or concave region with a radius of curvature of 7 inches or less wrapped with adhesive sheets made of a base material providing at least 20% elongation. For rollers 17 having convex or concave regions with a radius of curvature of 6 inches or less, it is preferred that the adhesive sheets 47 be made of a base material providing at least 150% elongation. Meanwhile, a preferred roller assembly having a roller with a concentric convex or concave region with a radius of curvature of 5 inches or less is preferably wrapped with adhesive sheets made of a base material providing at least 200% elongation. Acceptable materials for the adhesive sheet's base material providing at least 200% elongation include polyethylene, polyurethane, and silicone based plastics.

The various components of the adhesive roller assembly 1 can be made of various materials, and of various shapes and sizes. Preferably, the handle 5, hollow shaft 11, and roller 17 are made of a hard material such as wood, plastic, or even metal. Preferably, the rollers width is 1-6 inches for general household use such as cleaning upholstery or removing beard hair. However, even wider rollers may be employed such as for industrial cleaning. In addition, the rollers circumferential surface 25 can employ any shape so long as the circumferential surface is not cylindrical.

For example, with reference to FIGS. 1 and 13, a preferred adhesive roller assembly 1 includes a roller 17 having a convex region 33 which extends the entire width of the roller from the roller's first end 21 to the roller's second end 23. An alternative preferred roller embodiment illustrated in FIGS. 2 and 14 has a concave surface 31 that extends concentrically about the roller's central axis 35. Advantageously, the concave and convex rollers can be swapped for use with a single handle 5.

Figure 3:
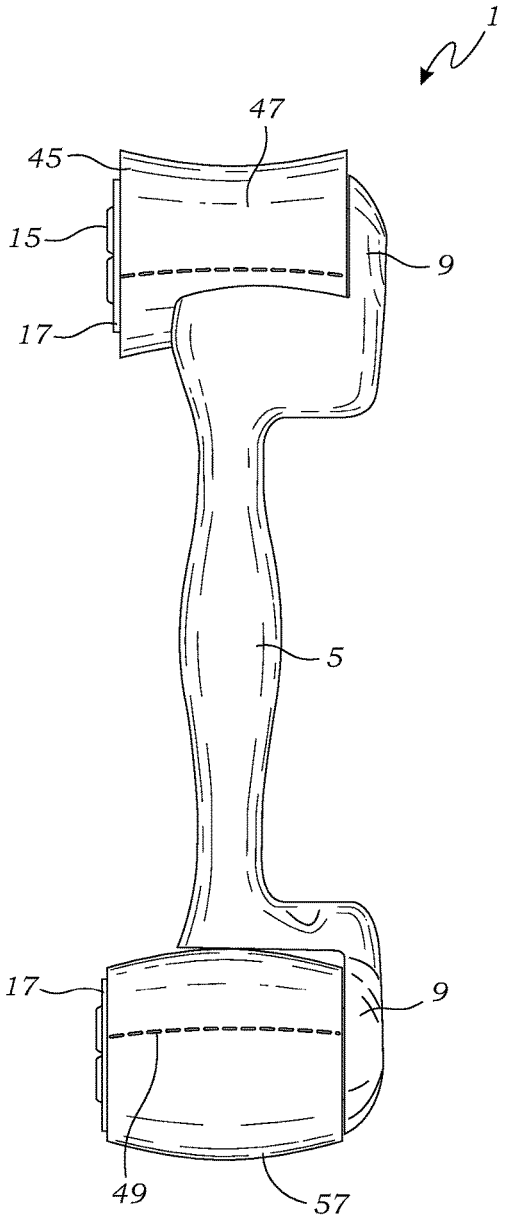
FIG. 3 is a front view of an alternative embodiment of the adhesive roller assembly.
Figure 4:
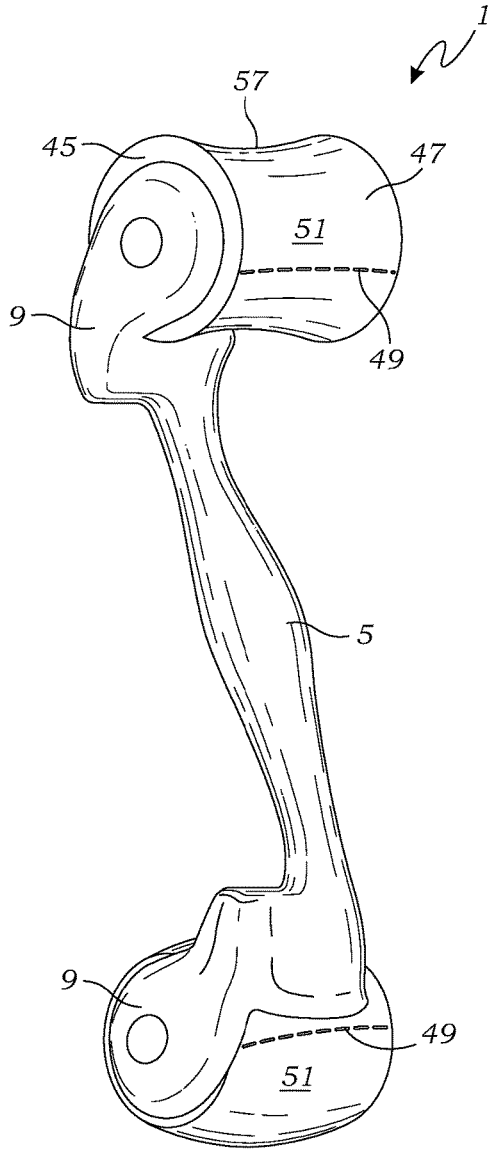
FIG. 4 is a perspective view of the adhesive roller assembly illustrated in FIG. 3.
Figure 5:
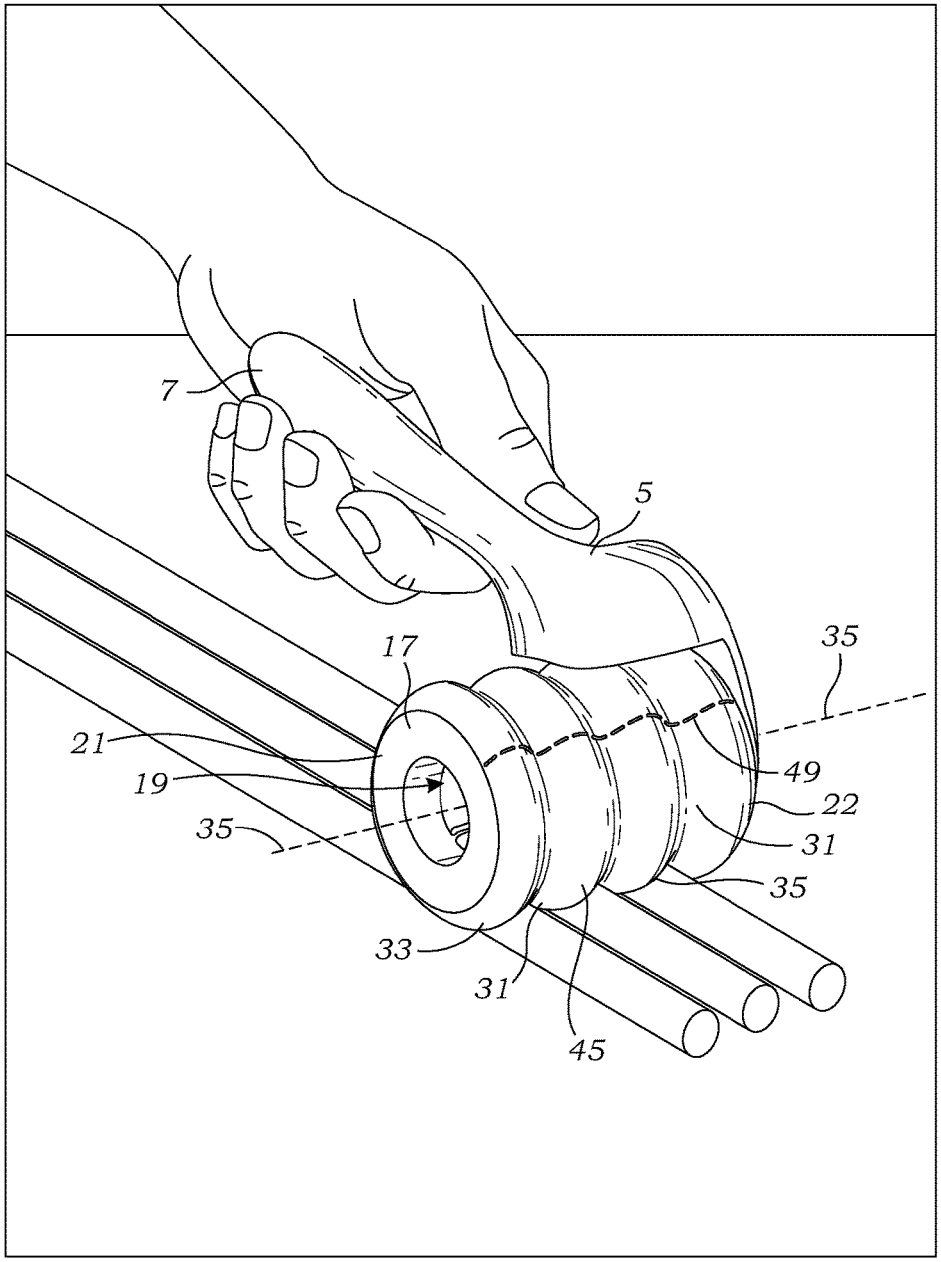
FIG. 5 is a perspective view illustrating operation of an additional embodiment of the adhesive roller assembly.

In still an addition preferred embodiment illustrated in FIGS. 3 and 4, the adhesive roller assembly 1 includes a handle 5 having two distal ends 9 with each end rotatably supporting a different shaped roller 17. Since the adhesive roller assembly 1 can support two different shaped rollers, it is preferred that a first roller 17 be constructed to include a concave circumferential surface supporting adhesive tape providing a concave shaped exterior 57. In addition, the same adhesive roller assembly 1 includes a second roller 17 which has a convex circumferential surface to accept adhesive tape wrapped to provide a convex exterior.

Alternatively, a roller may be constructed to include one or more concave regions 31 and one or more convex regions 33. For example, a preferred adhesive roller assembly 1 illustrated in FIG. 5 includes a roller 17 having a circumferential surface having four concentric convex regions 33 and three concentric concave regions 31. After the adhesive tape 45 has been wrapped around the roller's circumferential surface, the tape's exterior 57 includes a longitudinally undulating pattern which is particularly useful for cleaning rod shaped items within the concave grooves.

Figure 6:
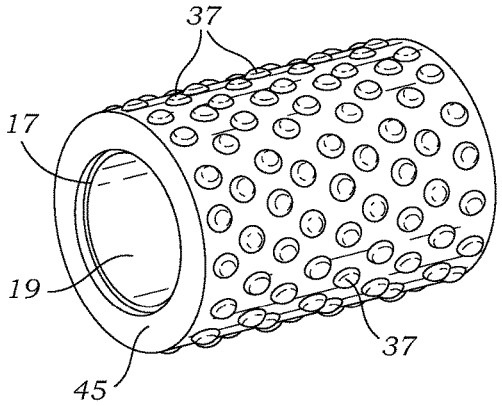
FIG. 6 is a perspective view of a roller having convex protuberances.
Figure 7:
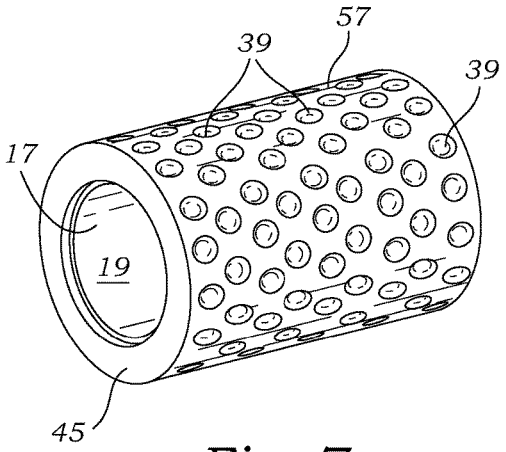
FIG. 7 is a perspective view of a roller having concave depressions.
Figure 8:
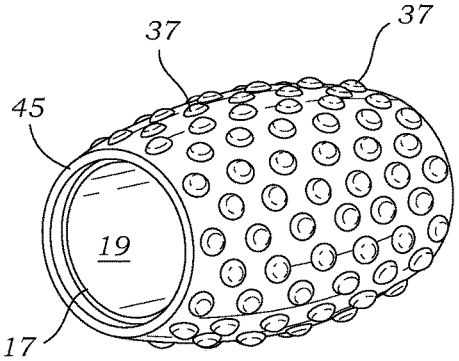
FIG. 8 is a perspective view of a roller having a convex circumferential surface and convex protuberances.
Figure 9:
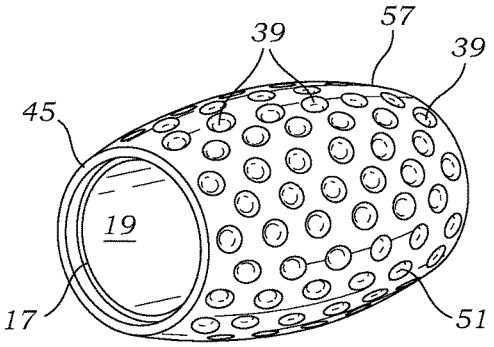
FIG. 9 is a perspective view of a roller having a convex circumferential surface and concave depressions.
Figure 10:
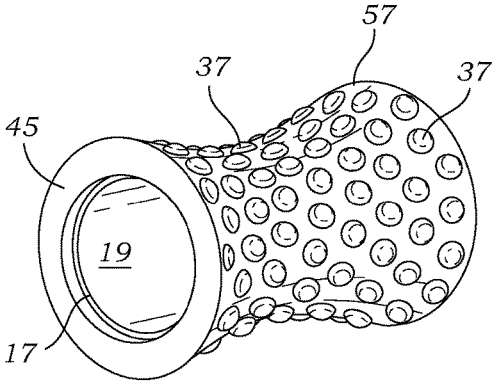
FIG. 10 is a perspective view of a roller having a concave circumferential surface and convex protuberances.

Still additional embodiments are illustrated in FIGS. 6-10. More particularly, FIGS. 6, 8 and 10 illustrate rollers 17 for use with the adhesive roller assembly that have a generally cylindrical construction (FIG. 6), a generally convex shape (FIG. 8), or a generally concave shape (FIG. 10). However, each of these rollers include additional convex protuberances 37 so that even the generally cylindrical construction shown in FIG. 6 is not considered herein to be cylindrical. As a result of the adhesive tape being made of a material having greater than traditional elongation, adhesive tape can be wrapped around such rollers to provide tape exteriors having multiple protuberances.

Figure 11:
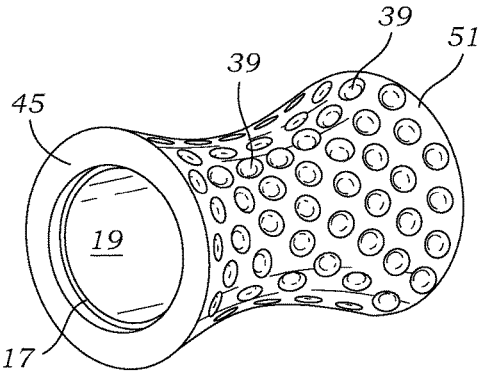
FIG. 11 is a perspective view of a roller having a concave circumferential surface and concave depressions.

Conversely, FIGS. 7, 9 and 11 illustrate rollers having generally cylindrical, convex, and concave circumferential surfaces, but the circumferential surfaces include a plurality of depressions 39. However, each of these rollers include additional concave depressions 39 so that even the generally cylindrical construction shown in FIG. 7 is not considered herein to be cylindrical. Again, because the adhesive tape's elastomeric properties provide increased elongation, the adhesive tape 45 can be wrapped to provide a non-cylindrical surface having a plurality of depressions. This surface with depressions is believed beneficial to collect larger particulates as larger debris is pushed into these depressions during use, thereby creating better entrapment via more surface contact.

The protuberances 37 or depressions 39 may be any shape or size. Adhesive roller assemblies 1 incorporating a roller having multiple protuberances 37 or multiple depressions 39 are believed to be particularly useful in collecting unwanted particulates from soft materials such as for the removal of lint from upholstery or excess hair from a person's beard.

Advantageously, the adhesive roller assembly 1 of the present invention has an unlimited number of usages. For example, as illustrated in FIGS. 16-20, the adhesive roller assembly 1 incorporating different shaped rollers such as convex, concave, or bumpy can be employed for a variety of cleaning operations including removing beard hair, cleaning upholstery, or cleaning computer keyboards.

While several particular forms of the invention have been illustrated and described, it will be apparent that various modifications can be made without departing from the spirit and scope of the invention. Therefore, having described my invention in such terms such as to enable a person skilled in the art to understand the invention, recreate the invention and practice it, and having presently identified the presently preferred embodiments thereof,

I claim:

1. The adhesive roller assembly comprising:

a handle;

a roller rotably affixed to said handle, said roller rotating about a central axis and having a first end, a second end, and a non-cylindrical circumferential surface concentric to said axis; and a plurality of adhesive sheets wrapped around said roller's circumferential surface to as to provide an annular arrangement of sheets having a non-cylindrical exterior, each of said sheets having a base material providing at least 12% elongation, and each of said sheets having an exterior adhesive coating.

2. The adhesive roller assembly of claim 1 wherein said roller's circumferential surface is concave concentrically about said central axis.

3. The adhesive roller assembly of claim 2 wherein said roller's concave circumferential surface has a radius of curvature and the distance between said roller's first end and second end defines said concave surface's width, and said circumferential surface having a ratio of width:radius of curvature between 2:1 and 1:3.

4. The adhesive roller assembly of claim 1 wherein said roller's circumferential surface is convex concentrically about said central axis.

5. The adhesive roller assembly of claim 4 wherein said roller's convex circumferential surface has a radius of curvature and the distance between said roller's first end and second end defines said convex surface's width, and said circumferential surface having a ratio of width:radius of curvature between 2:1 and 1:3.

6. The adhesive roller assembly of claim 1 wherein said roller's circumferential surface has a plurality of convex dimples.

7. The adhesive roller assembly of claim 1 wherein said roller's circumferential surface has a plurality of concave depressions.

8. The adhesive roller assembly of claim 1 wherein said roller's circumferential surface has at least one concave region formed concentrically about said central axis and at least one concave region formed concentrically about said central axis.

9. The adhesive roller assembly of claim 1 wherein said roller's circumferential surface has a plurality of concave regions formed concentrically about said central axis and a plurality of concave regions formed concentrically about said central axis.

10. The adhesive roller assembly of claim 1 wherein said roller's circumferential surface has a concentric convex or concave region with a radius of curvature of 7 inches or less and said adhesive sheets have a base material providing at least 20% elongation.

11. The adhesive roller assembly of claim 1 wherein said roller's circumferential surface has a concentric convex or concave region with a radius of curvature of 6 inches or less and said adhesive sheets have a base material providing at least 150% elongation.

12. The adhesive roller assembly of claim 1 wherein said roller's circumferential surface has a concentric convex or concave region with a radius of curvature of 5 inches or less and said adhesive sheets have a base material providing at least 200% elongation.

* * * * *